US006257263B1

(12) United States Patent
Brereton

(10) Patent No.: US 6,257,263 B1
(45) Date of Patent: Jul. 10, 2001

(54) POP-UP TENT

(75) Inventor: Anthony Paul Brereton, Cheshire (GB)

(73) Assignee: Finecard International Limited (GB)

( * ) Notice: Subject to any disclaimer, the term of this patent is extended or adjusted under 35 U.S.C. 154(b) by 0 days.

(21) Appl. No.: 09/611,784

(22) Filed: Jul. 7, 2000

(30) Foreign Application Priority Data

Jul. 10, 1999 (GB) ..... 9916119

(51) Int. Cl.[7] ..... E04H 15/40
(52) U.S. Cl. ..... 135/126; 135/125; 135/106
(58) Field of Search ..... 135/125, 126, 135/127, 128, 137, 138, 143, 116

(56) References Cited

U.S. PATENT DOCUMENTS 4,757,832 * 7/1988 Russell ..... 135/106
5,467,794 * 11/1995 Zheng ..... 135/125
5,601,105 * 2/1997 Blen et al. ..... 135/126
5,778,915 * 7/1998 Zheng ..... 135/126

* cited by examiner

*Primary Examiner*—Carl D. Friedman
*Assistant Examiner*—Steve Verner
(74) *Attorney, Agent, or Firm*—Samuels, Gauthier & Stevens

(57) ABSTRACT

A portable pop-up self-supporting of tent-like form comprising a pair of hinged side members (A) and (B) each consisting of a flexible sheet having a peripheral coilable frame. The two side members are hinged along adjacent edges and the opposed edges are joined by flexible base sheet (C). The triangular ends of the tent may be closed by a flexible material including an access flap if required. The base of the tent is held apart by a removable and separate panel member (D) also consisting of a flexible panel having a peripheral coilable semi-rigid frame. The entire structure comprising the side members and the separate base member may be coiled into overlaying loops for storage and, is self-erecting when released.

10 Claims, 1 Drawing Sheet

POP-UP TENT

THIS INVENTION concerns quickly erectable, quickly collapsible, self-supporting portable structures and in particular such a structure being of tent-like form.

So-called pop-up structures of this kind are known in various forms and consist essentially of a number of hingedly attached side members each comprised by a panel of foldable material held taut by a peripheral frame formed from a flexible coilable material, which frame forms a single loop when expanded and three overlaying loops when collapsed. This principle of construction is utilised in the present invention thus to provide a structure which may form a ridge tent.

The prior art includes such a structure in which a pair of side members of generally rectangular form are hingedly connected together along two adjacent sides, the opposite sides of the respective side members being connected together by a flexible sheet such that the two side members may be folded flat and then coiled in the manner of other so-called pop-up structures. When opened out, the structure may form, for example, a ridge tent with generally triangular ends one of which contain a flap to serve as a door for access and the base of the structure is held apart such that the flexible base sheet is held taut by removable rods or the like.

According to the present invention there is provided a portable structure operable for transforming from a fully collapsed configuration into an upstanding fully expanded configuration and thence back into a fully collapsed configuration, the structure in the fully expanded configuration having a base intended for resting on a horizontal surface, and a top, the structure comprising at least two side members one or more of said side members having a continuous frame formed from a flexible coilable material, the frame forming a single loop when expanded and three overlaying loops when collapsed, and a panel formed from a foldable material, the panel having means for confining the frame whereby when the frame is expanded the panel is pulled taught by the frame; the panels being connected together along the top and having a flexible sheet at the base which sheet is made taut when the opposed sides are held apart; characterised by a further and separate panel member also formed as a continuous frame of flexible coilable material with a panel of foldable material having means confining the frame whereby when the frame is expanded it forms a semi-rigid framed panel which may be removably placed on the flexible sheet within the structure to hold the sides apart.

The structures may therefore consist of two separable parts one being the two side members and the flexible base sheet and the other being the framed base panel, the two parts being separately collapsible each into three overlaying loops for storing.

An embodiment of the invention will now be described, by way of example only, with reference to the accompanying drawings, in which.

Figure 1:
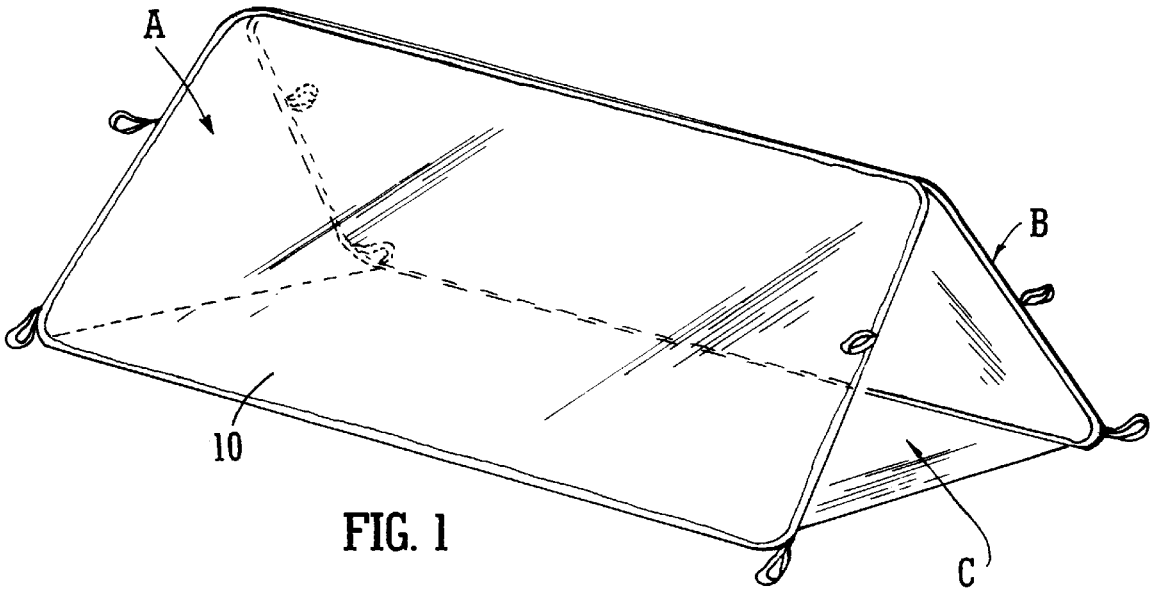
FIG. 1 illustrates a portable structure made in accordance with the invention and shown in a fully expanded configuration.

Therefore, with reference to the drawings, a structure of this kind comprises two side members A and B and a base C, which in the fully expanded configuration are disposed such that base C rests upon the ground or a floor. Each side member comprises a panel 10 of a foldable material such as nylon, the panels of two adjacent edges of two of the side members A and B being joined by stitching at 12. Also joined by the stitching at 12 to the respective side members is a pair of pockets 13 each pocket extending peripherally around its respective side member and containing a continuous frame 14 formed from a flexible coilable material such as spring steel. The characteristics of the frame of each side member are such that in the expanded condition of the structure the associated panel 10 is held taut thereby. In this manner, the side members A and B, are hingedly attached together. The base C consists of a flexible sheet stitched along two opposed edges to the panels 10 of the side members A and B to extend loosely between them.

Thus, the structure in its fully expanded and upright configuration may form a ridge tent having triangular ends and inclined sides A and B. The end elevations may be closed by a mesh or other foldable material 16 which may be attached, for example, to sides A and B thus to close the ends of the tent. A flap will provided to gain access to the interior. Loops 17 at the four corners of the base may be provided for receiving pegs or the like to fix the structure to the ground or floor. Further loops 18 on opposed ends of side members A and B may receive, for example, guy ropes to stabilise the structure.

In accordance with the invention, a separate base member D (FIG. 2) is provided which is similar to member A or B and consists of a panel 20 of foldable material such as nylon having a pocket similar to pocket 13 around its peripheral edge and containing a continuous frame similar to frame 14 formed from a flexible coilable material such as spring steel. The panel 20 may be padded and quilted or otherwise stitched as illustrated as 21. By inserting the base member D into the structure, preferably through the flap at one or other end of the structure, it will form a semi-rigid base for the structure holding the opposed bottom sides of panels A and B apart and will sit on the flexible sheet of the base C. Thus, the structure forms a tent held erect by the sides A and B and the base member D.

Figure 4:
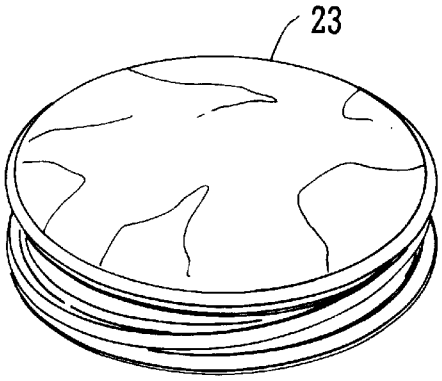
FIG. 4 illustrates the structure in a fully collapsed configuration.

The structure may be collapsed in a manner similar to other pop-up devices after removal of the base member D whereupon side members A and B are folded flat to form two superimposed flat sides. By appropriate twisting of the then-superimposed frames 14 the entire structure may be formed into three overlaying loops as illustrated at 23 in FIG. 4 with the foldable material collapsed and enclosed between them. The same process is used to collapse the separate base member D. Thus the entire structure becomes very compact and may be inserted as a whole into a bag or the like for storage. When the structure is removed from the bag and released the two sides A and B and the base member D are self-erecting and by placing member D between the lower edges of members A and B the structures as illustrated in FIG. 1 is formed.

Figure 2:
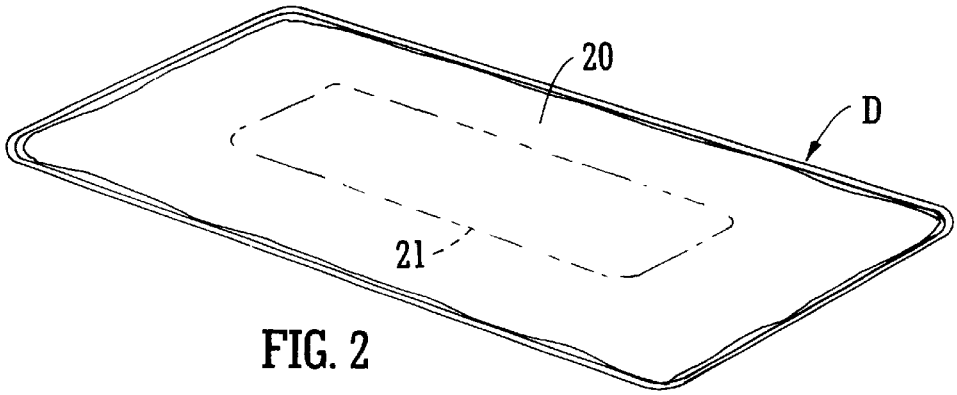
FIG. 2 illustrates a removable base panel for the structure.
Figure 3:
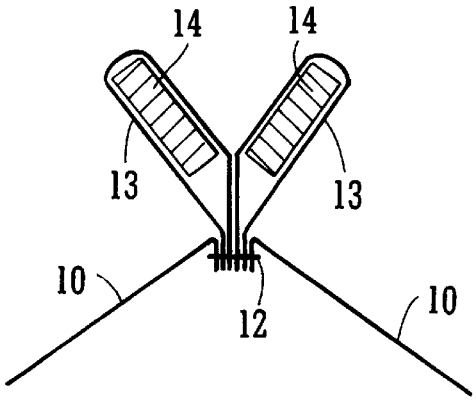
FIG. 3 illustrates a detailed part of the structure.

In an alternative structure (not shown) the sides (two or four in number) may be formed from a coilable figure-of-eight framework such as is shown in patent specification EP 0331 029 but wherein a flexible base sheet extends between the side walls and wherein the structure is held in a stable condition by a coilable base panel such as panel D in FIG. 2 hereto.

What is claimed is:

1. A portable structure operable for transforming form a fully collapsed configuration into an upstanding fully expanded configuration and thence back into a fully collapsed configuration, the structure in the fully expanded configuration having a base intended for resting on a horizontal surface, and a top, the structure comprising at least two side members one or more of said side members having a continuous frame formed from a flexible coilable material, the frame forming a single loop when expanded and three overlaying loops when collapsed, and a panel formed from a foldable material, the panel having means for confining the frame whereby when the frame is expanded the panel is pulled taught by the frame; the panels being connected together along the top and having a flexible sheet at the base which sheet is made taut when the opposed sides are moved apart; characterised by a further and separate panel member also formed as a continuous frame of flexible coilable material with a panel of foldable material having means confining the frame whereby when the frame is expanded it forms a semi-rigid framed panel which may be removably placed on the flexible base sheet within the structure to hold the sides apart.

2. A portable structure according to claim 1, consisting of two separable parts, one comprising the two side members and the flexible base sheet, and the other being the framed base panel, the two parts being separately collapsible each into three overlaying loops for storing.

3. A portable structure according to claim 1, wherein the two side members are hingedly attached together.

4. A portable structure according to claim 1, wherein the flexible base sheet is attached along two opposed edges to the panels of the side members to extend loosely between them.

5. A portable structure according to claim 1, in its fully expanded and upright configuration forms a ridge tent having triangular ends and inclined sides.

6. A portable structure according to claim 5, wherein the ridge tent includes end elevations closed by a flexible material.

7. A portable structure according to claim 1, wherein the further and separate panel member consists of a panel of foldable material having a peripheral pocket containing a frame formed from spring steel.

8. A portable structure according to claim 7, wherein the further and separate panel member is padded.

9. A portable structure according to claim 1, wherein each of the side members and the further and separate panel member are formed each to be twisted into three overlaying loops with the foldable material collapsed and enclosed between them, the three members being self-erecting when released.

10. A portable structure according to claim 1, wherein the side members are formed from a coilable figure-of-eight framework.

* * * * *